US009037048B2

(12) United States Patent
Berg et al.

(10) Patent No.: US 9,037,048 B2
(45) Date of Patent: May 19, 2015

(54) DIGITAL PRINTER HAVING AN IMPROVED LIQUID DEVELOPER SUPPLY SYSTEM

(71) Applicants: Martin Berg, Poing (DE); Matthias Andres, Poing (DE)

(72) Inventors: Martin Berg, Poing (DE); Matthias Andres, Poing (DE)

(73) Assignee: Océ Printing Systems GmbH, Poing (DE)

( * ) Notice: Subject to any disclaimer, the term of this patent is extended or adjusted under 35 U.S.C. 154(b) by 137 days.

(21) Appl. No.: 13/862,505

(22) Filed: Apr. 15, 2013

(65) Prior Publication Data

US 2013/0272748 A1 Oct. 17, 2013

(30) Foreign Application Priority Data

Apr. 17, 2012 (DE) ..... 10 2012 103 326

(51) Int. Cl.
*G03G 15/10* (2006.01)

(52) U.S. Cl.
CPC ..... *G03G 15/10* (2013.01); *G03G 15/104* (2013.01)

(58) Field of Classification Search
USPC ..... 399/237–239
See application file for complete search history.

(56) References Cited

U.S. PATENT DOCUMENTS

| | | | | |
|---|---|---|---|---|
| 5,561,264 | A | 10/1996 | Iino et al. | |
| 5,826,148 | A | 10/1998 | Iino et al. | |
| 6,895,200 | B2 | 5/2005 | Tagansky | |
| 7,292,810 | B2 | 11/2007 | Tanner et al. | |
| 7,522,865 | B2 | 4/2009 | Hasdai et al. | |
| 8,437,664 | B2 * | 5/2013 | Nelson | 399/237 |
| 2003/0180070 | A1 | 9/2003 | Dougherty et al. | |
| 2009/0232533 | A1 | 9/2009 | Toyama et al. | |
| 2009/0290901 | A1 | 11/2009 | Ishii et al. | |
| 2011/0150534 | A1 | 6/2011 | Kopp | |

FOREIGN PATENT DOCUMENTS

| | | | |
|---|---|---|---|
| DE | 10 2008 048 256 | A1 | 4/2010 |
| DE | 10 2009 060 334 | A1 | 6/2011 |
| DE | 10 2010 015 985 | A1 | 9/2011 |
| JP | 2002-278295 | A | 9/2002 |

* cited by examiner

*Primary Examiner* — William J Royer
(74) *Attorney, Agent, or Firm* — Schiff Hardin LLP

(57) ABSTRACT

In a digital printer comprising a developer station using liquid developer, the developer station has an application unit via which liquid developer is transported to a charge image carrier. The supply system adjacent and lateral to the application unit supplies liquid developer to the application unit. A pre-chamber and an electrode segment are provided, the pre-chamber being filled with liquid developer and open towards the application unit. The pre-chamber is open at a top such that a compensation volume of liquid developer with an open surface is created past which the application unit passes. The electrode segment is arranged adjacent to the pre-chamber and to a side of the application unit such that it forms a gap with the application unit through which the liquid developer is directed, the electrode segment being at an electrical potential such that toner of the liquid developer transfers to the application unit in the gap.

17 Claims, 5 Drawing Sheets

DIGITAL PRINTER HAVING AN IMPROVED LIQUID DEVELOPER SUPPLY SYSTEM

BACKGROUND

The disclosure concerns a digital printer to print a recording medium with toner particles that are applied with the aid of a liquid developer, in particular a high-speed printer to print web-shaped or sheet-shaped recording media.

In such digital printers, a latent charge image of a charge image carrier is inked by means of electrophoresis with the aid of a liquid developer. The toner image that is created in such a manner is transferred indirectly (via a transfer element) or directly to the recording medium. The liquid developer has toner particles and cleaning fluid in a desired ratio. Mineral oil is advantageously used as a cleaning fluid. In order to provide the toner particles with an electrostatic charge, charge control substances are added to the liquid developer. Further additives are additionally added, for example in order to achieve the desired viscosity or a desired drying behavior of the liquid developer.

Such digital printers have been known for a long time, for example from DE 10 2010 015 985 A1, DE 10 2008 048 256 A1 or DE 10 2009 060 334 A1.

To ink the charge images on the charge image carrier, liquid developer is directed past the charge image carrier by a developer station. The developer station has a developer roller (the manner is known per se) that directs the liquid developer past the charge image carrier; an application system that supplies the liquid developer to the developer roller; and a cleaning unit that cleans off the residual liquid developer that remains on the developer roller after the inking of the charge images at the charge image carrier. For example, the cleaning unit provides a cleaning roller that removes the residual liquid developer from the developer roller; an electric field thereby exists between developer roller and cleaning roller, for example, which electric field promotes the transfer of the residual liquid developer. The residual liquid developer can be scraped off the cleaning roller by a blade. No residual liquid developer should thereby remain on the cleaning roller, since otherwise it could arrive again at the developer roller.

Developer stations are known in which liquid developer is supplied to a charge image carrier. In U.S. Pat. Nos. 7,522,865 B2, 7,292,810 B2, 6,895,200 B2, developer stations are described in which liquid developer is directed past a developer roller. Arranged adjacent to the developer roller is an electrode. The liquid developer is directed between the electrode and the developer roller. An electric voltage exists between the electrode and the developer roller, via which electric voltage the toner is drawn towards the developer roller.

SUMMARY

It is an object to provide a digital printer to print to a recording medium that has a high process stability given minimized loading of the liquid developer due to low mechanical stress, and a high print quality via uniform properties of the liquid developer. In particular, a supply system for liquid developer to an application unit in the developer station should be realized so that the transfer of the liquid developer (in particular of the toner particles) to the application unit is optimized. A developer roller, a developer belt, or an application roller for a developer roller can be provided as an application unit.

In a digital printer comprising a developer station using liquid developer, the developer station has an application unit via which liquid developer is transported to a charge image carrier. The supply system adjacent and lateral to the application unit supplies liquid developer to the application unit. A pre-chamber and an electrode segment are provided, the pre-chamber being filled with liquid developer and open towards the application unit. The pre-chamber is open at a top such that a compensation volume of liquid developer with an open surface is created past which the application unit passes. The electrode segment is arranged adjacent to the pre-chamber and to a side of the application unit such that it forms a gap with the application unit through which the liquid developer is directed, the electrode segment being at an electrical potential such that toner of the liquid developer transfers to the application unit in the gap.

DESCRIPTION OF PREFERRED EXEMPLARY EMBODIMENTS

Figure 1:
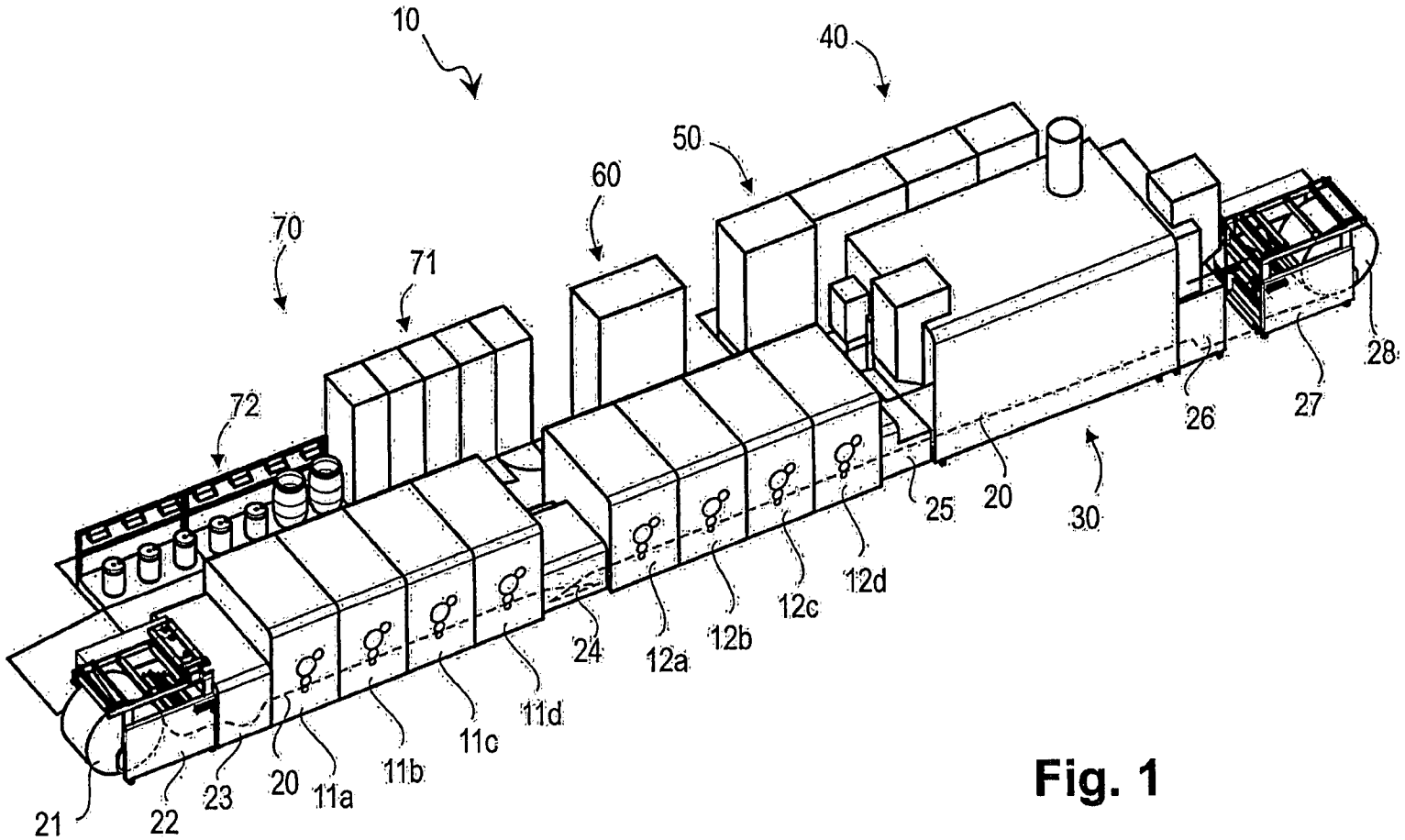
FIG. 1 shows a view of a digital printer in an exemplary configuration of the digital printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

The digital printer to print to a recording medium has at least one print group with at least one electrography station to generate charge images of images to be printed on a charge image carrier, and with at least one developer station to ink the charge images on the charge image carrier using liquid developer.

For this the developer station comprises:

- a rotating application unit via which liquid developer is transported to the charge image carrier; the application unit can be a developer roller that transports the liquid developer to the charge image carrier, or an application roller that transports the liquid developer to the developer roller;
- a supply system arranged adjacent to the application unit for the transport of liquid developer to the application unit, with a pre-chamber and an electrode segment, wherein the pre-chamber is open at the top and towards the application unit and is filled with liquid developer, such that the application unit can accept liquid developer from the pre-chamber; and wherein the electrode segment is at such an electrical potential that toner of the liquid developer passes to the application unit.

It is advantageous if the pre-chamber has a spillover for excess liquid developer, since then more liquid developer can be supplied to the pre-chamber than is transferred to the application unit. The pre-chamber is thereby continuously filled with liquid developer, and the liquid developer is continuously exchanged. The liquid developer in the pre-chamber forms a compensation volume via which a uniform distribution of the toner particles at the fill level of the pre-chamber is achieved.

It is advantageous if the supply system provides the electrode segment at the top side and the pre-chamber at the underside. The electrode segment can then have a molding that is drawn in the liquid developer up to the region below the spillover of the pre-chamber. This measure ensures that no air bubbles can arise in the compensation volume of the pre-chamber.

It is additionally advantageous if the electrode segment opens at the side of the application unit, into an end part that extends along the application unit. The transfer region of toner to the application unit can thereby be lengthened.

In a further embodiment, the supply system is arranged at an application roller as an application unit to which the liquid developer is transferred. The liquid developer is then directed over from the application roller to the developer roller.

It is advantageous if the excess liquid developer is supplied from the pre-chamber of a cleaning unit having a cleaning roller and a cleaning blade, which cleaning unit cleans the residual liquid developer remaining after the development of the charge images off of the developer roller. The cleaning blade or the cleaning roller can then be cleaned of cleaned-off toner with the liquid developer.

Exemplary embodiments are explained in detail in the following using schematic drawings.

According to FIG. 1, a digital printer 10 to print to a recording medium 20 has one or more print groups 11*a*-11*d* and 12*a*-12*d* that print a toner image (print image 20'; see FIG. 2) to the recording medium 20. As a recording medium 20, as shown a web-shaped recording medium 20 is unrolled from a roll 21 with the aid of an unroller 22 and is supplied to the first print group 11*a*. In a fixing unit 30, the print image 20' is fixed on the recording medium 20. The recording medium 20 can subsequently be rolled up on a roll 28 with the aid of a take-up stand 27. Such a configuration is also designated as a roll-to-roll printer.

In the preferred configuration shown in FIG. 1, the web-shaped recording medium 20 is printed in full color with four print groups 11*a* through 11*d* on the front side and with four print groups 12*a* through 12*d* on the back side (what is known as a 4/4 configuration). For this, the recording medium 20 is unwound by the unroller 22 from the roll 21 and supplied via an optional conditioning group 23 to the first print group 11*a*. In the conditioning group 23, the recording medium 20 can be pre-treated or coated with a suitable substance. Wax or chemically equivalent substances can advantageously be used as a coating substance (also designated as a primer).

This substance can be applied over the entire surface of the recording medium 20—or only to the points of the recording medium 20 that are to be printed later—in order to prepare the recording medium 20 for the printing and/or to affect the absorption response of the recording medium 20 upon application of the print image 20'. It is therefore prevented that the later applied toner particles or the cleaning fluid do not penetrate too significantly into the recording medium 20, but rather essentially remain on the surface (color quality and image quality are thereby improved).

The recording medium 20 is subsequently initially supplied in order to the first print groups 11*a* through 11*d* in which only the front side is printed. Each print group 11*a*-11*d* typically prints the recording medium 20 in a different color, or also with different toner material (for example MICR toner, which can be read electromagnetically).

After the printing of the front side, the recording medium 20 is turned in a turning unit 24 and supplied to the remaining print groups 12*a*-12*d* to print the back side. An additional conditioning group (not shown) can optimally be arranged in the region of the turning unit 24, via which the recording medium 20 is prepared for the printing of the back side, for example a fixing (partial fixing) or other conditioning of the previously printed front side print image (or, respectively, the entire front side or back side as well). It is thus prevented that the front side print image is mechanically damaged upon additional transport through the subsequent print groups.

In order to achieve a full-color printing, at least four colors (and therefore at least four print groups 11, 12) are required, namely the primary colors YMCK (yellow, magenta, cyan and black), for example. Additional print groups 11, 12 with special colors (for example customer-specific colors or additional primary colors in order to expand the printable colors space) can also be used.

Arranged after the print group 12*d* is a registration unit 25 via which registration marks that are printed on the recording medium 20 independently of the print image 20' (in particular outside of the print image 20') are evaluated. The transversal and longitudinal register (the primary color points that form a color point should be arranged over one another or spatially very closely adjacent to one another; this is also designated as color register or four-color register) and the register (front side and back side must spatially coincide precisely) can thereby be adjusted so a qualitatively good print image 20' is achieved.

Arranged after the registration unit 25 is the fixing unit 30 via which the print image 20' is fixed on the recording medium 20. In electrophoretic digital printers, a thermo-dryer is advantageously used as a fixing unit 30 that largely evaporates the cleaning fluid so that only the toner particles remain on the recording medium 20. This occurs under the effect of heat. The toner particles on the recording medium 20 can thereby also be fused insofar as they have a material (resin, for example) that can be fused as the result of a heating effect.

Arranged after the fixing unit 30 is a feed group 26 that pulls the recording medium 20 through all print groups 11*a*-12*d* and the fixing unit 30 without an additional drive being arranged in this region. The danger that the print image 20' that has not yet been fixed could be smeared would exist due to a friction feed for the recording medium 20.

The feed group supplies the recording medium 20 to the take-up stand 27 that rolls up the printed recording medium 20.

Centrally arranged in the print groups 11, 12 and the fixing unit 30 are all supply devices for the digital printer 10, such as climate control modules 40, power supply 50, controller 60, modules for fluid management 70, fluid control unit 71 and storage reservoir 72 of the different fluids. In particular, pure carrier fluid, highly concentrated liquid developer (high proportion of toner particles in relation to the cleaning fluid) and serum (liquid developer plus charge control substances) are required as liquids in order to supply the digital printer 10, as well as waste reservoirs for liquids to be disposed of or containers for cleaning fluid.

The digital printer 10 is of modular design with its structurally identical print groups 11, 12. The print groups 11, 12 do not differ mechanically, but rather only in the liquid developers that are to be used in them (toner color or toner type).

Figure 2:
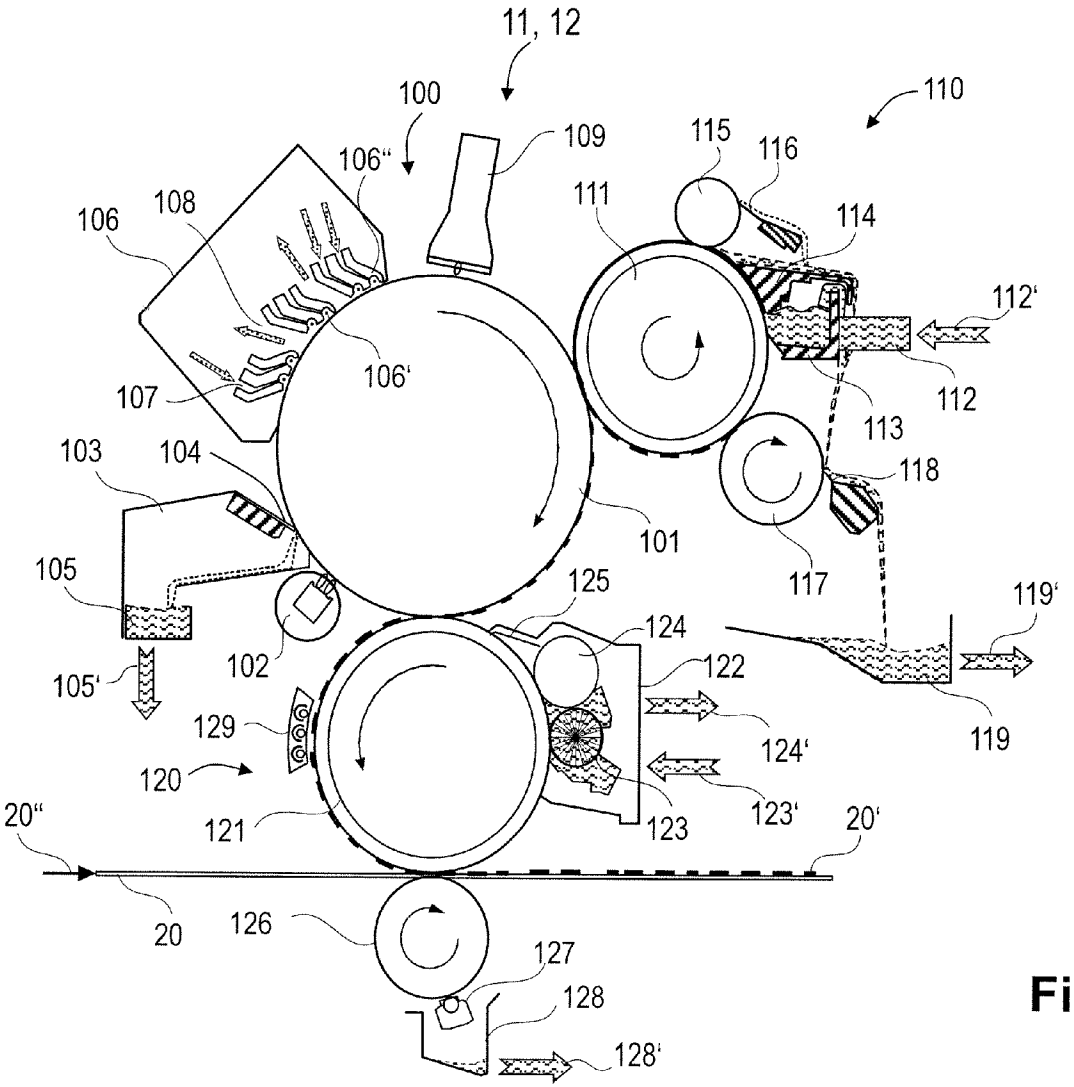
FIG. 2 illustrates a schematic diagram of a print group of the digital printer according to FIG. 1.

The design of a print group 11, 12 in principle is shown in FIG. 2. Such a print group is based on the electrophotographic principle, in which a photoelectric image carrier is inked with charged toner particles with the aid of a liquid developer and the image that is created in such a manner is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). Here the photoconductor is designed as a roller (photoelectric roller 101) and has a hard surface. The photoelectric roller 101 rotates past the various elements to generate a print image 20' (rotation in the direction of the arrow).

The photoconductor is initially cleaned of all contaminants. For this, an erasing light 102 is present that erases charges that still remain on the surface of the photoconductor. The erasing light 102 can be coordinated (locally adjusted) in order to achieve a homogeneous light distribution. The surface can therefore be pre-treated uniformly.

After the erasing light 102, a cleaning device 103 mechanically cleans off the photoconductor in order to remove toner particles (possibly dirt particles) and remaining cleaning fluid that are possibly still present on the surface of the photoconductor. The cleaned-off cleaning fluid is supplied to a collection reservoir 105. The collected cleaning fluid and toner particles are prepared (possibly filtered) and supplied depending on the color to a corresponding liquid color storage, i.e. to one of the storage reservoirs 72 (see arrow 105').

The cleaning device 103 advantageously has a blade 104 that rests on the generated surface of the photoconductor roller 101 at an acute angle (for instance 10° to 80° relative to the outlet surface) in order to mechanically clean off the surface. The blade 104 can move back and forth transverse to the rotation direction of the photoconductor roller 101 in order to clean the generated surface with as little wear as possible on the entire axial length.

The photoconductor is subsequently charged by a charging device 106 to a predetermined electrostatic potential. Multiple corotrons (in particular glass shell corotrons) are advantageously present for this. The corotrons comprise at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for ventilation and exhaust channel 108 to exhaust) between the shields (see also air flow arrows in FIG. 2). The supplied air is then ionized uniformly at the wire 106'. A homogeneous, uniform charge of the adjacent surface of the photoconductor is thereby achieved. The uniform charge is further improved with dry and heated air. Air is discharged via the exhaust channels 108. Ozone that is possibly created can likewise be drawn off via the exhaust channels 108.

The corotrons can be cascaded, meaning that two or more wires 106' are then present per shield 106" given the same shield voltage. The current that flows across the shield 106" can be adjusted, and the charge of the photoconductor can thereby be controlled. The corotrons can be fed with different amounts of current in order to achieve a uniform and sufficiently high charge at the photoconductor.

Arranged after the charging device 106 is a character generator 109 that discharges the photoconductor per pixel via optical radiation, depending on the desired print image 20'. A latent image is thereby created that is inked later with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical image points on the photoconductor determine the resolution of the print image 20' (typical resolution is 600×600 dpi). The LEDs can be controlled individually in terms of time and with regard to their radiation power. Multilevel methods can thus be applied to generate raster points (comprising multiple image points or pixels), or image points are time-delayed in order to implement corrections electro-optically, for example given uncorrected color registration or register.

The character generator 109 has a control logic that must be cooled, due to the plurality of LEDs and their radiation power. The character generator 109 is advantageously liquid-cooled. The LEDs can be activated per group (multiple LEDs assembled into a group) or separately from one another.

The latent image generated by the character generator 109 is inked with toner particles by the developer station 110. For this the developer station 110 has a rotating developer roller 111 that directs a layer of liquid developer towards the photoconductor (the functionality of the developer station 110 is explained in detail further below). Since the surface of the photoconductor roller 101 is relatively hard, the surface of the developer roller 111 is relatively soft, and the two are pressed against one another; a thin, high nip (a gap between the rollers) is created in which the charged toner particles migrate electrophoretically from the developer roller 111 to the photoconductor at the image points due to an electrical field. In the non-image points, no toner transfers to the photoconductor. The nip filled with liquid developer has a height (thickness of the gap) that is dependent on the mutual pressure of the two rollers 101, 111 and the viscosity of the liquid developer. The height of the nip typically lies in a range greater than approximately 2 μm to approximately 20 μm (the values can also change depending on the viscosity of the liquid developer). The length of the nip amounts to a few millimeters, for instance.

The inked image rotates with the photoconductor roller 111 up to a first transfer point at which the inked image is essentially transferred completely to a transfer roller 121. The transfer roller 121 moves to the first transfer point (nip between photoconductor roller 101 and transfer roller 121) in the same direction, and advantageously with identical velocity as the photoconductor roller 101. After the transfer of the print image 20' to the transfer roller 121, the print image 20' (toner particles) can optionally be recharged or charged by means of a charging unit 129 (a corotron, for example) in order to be able to subsequently transfer the toner particles better to the recording medium 20.

The recording medium 20 runs through between the transfer roller 121 and a counter-pressure roller 126 in the transport direction 20". The contact region (nip) represents a second transfer point in which the toner image is transferred to the recording medium 20. In the second transfer region, the transfer roller 121 moves in the same direction as the recording medium 20. The counter-pressure roller 126 rotates in this direction in the region of the nip. The velocities of the transfer roller 121, the counter-pressure roller 126 and the recording medium 20 are matched to one another at the transfer point and are advantageously identical, such that the print image 20' is not smeared. At the second transfer point, the print image 20' is transferred electrophoretically to the recording medium 20 due to an electrical field between the transfer roller 121 and the counter-pressure roller 126. Moreover, the counter-pressure roller 126 presses with high mechanical force against the relatively soft transfer roller 121, whereby the toner particles remain stuck to the recording medium 20 due to the adhesion.

Since the surface of the transfer roller 121 is relatively soft and the surface of the counter-pressure roller 126 is relatively hard, a nip is created upon unrolling, in which nip the toner transfer occurs. Irregularities in the thickness of the recording medium 20 can therefore be equalized, such that the recording medium 20 can be printed without gaps. Such a nip is also well suited to print thicker or more uneven recording media 20, for example as is the case in the printing of packaging.

The print image 20' should in fact transfer to the recording medium 20; nevertheless, a few toner particles can nevertheless undesirably remain on the transfer roller 121. A portion of the cleaning fluid always remains on the transfer roller 121 as a result of the wetting. The toner particles that are possibly still present should be nearly entirely removed by a cleaning unit 122 following the second transport point. The cleaning fluid that is still located on the transfer roller 121 can also be completely removed from the transfer roller 121, or can be removed up to a predetermined layer thickness, so that identical conditions prevail after the cleaning unit 122 and before the first transfer point from the photoconductor roller 101 to the transfer roller 121 due to a clean surface or a defined layer thickness with liquid developer on the surface of the transfer roller 121.

This cleaning unit 122 is advantageously designed as a wet chamber with a cleaning brush 123 and a cleaning roller 123. In the region of the brush 123, cleaning fluid (for example carrier fluid or a separate cleaning fluid are used) is supplied via a cleaning fluid supply 123'. The cleaning brush 123 rotates in the cleaning fluid and thereby "brushes" the surface of the transfer roller 121. The toner adhering to the surface is thereby loosened.

The cleaning roller 124 lies at an electrical point in time that is opposite the charge of the toner particles. As a result of this, the electrically charged toner is removed from the transfer roller 121 by the cleaning roller 124. Since the cleaning roller 123 touches the transfer roller 121, it also removes cleaning fluid remaining on the transfer roller 121, together with the supplied cleaning fluid. A conditioning element 125 is arranged at the outlet from the wet chamber. As shown, a retention plate can be used as a conditioning element 125, which retention plate is arranged at an obtuse angle (for instance between 100° and 170° between plate and outlet surface) relative to the transfer roller 121, whereby residues of fluid on the surface of the roller are nearly completely retained in the wet chamber and are supplied to the cleaning roller 124 for removal via a cleaning fluid discharge 124' to a cleaning fluid reservoir (in the storage reservoirs 72) that is not shown.

Instead of the retention plate, a dosing unit (not shown) can also be arranged there that, for example, has one or more dosing rollers. The dosing rollers have a predetermined clearance from the transfer roller 121 and receive so much cleaning fluid that a predetermined layer thickness arises after the dosing rollers as a result of the squeezing. The surface of the transfer roller 121 is then not completely cleaned off; cleaning fluid of a predetermined layer thickness remains over the entire surface. Removed cleaning fluid is directed via the cleaning roller 124 back to the cleaning fluid storage reservoir.

The cleaning roller 124 itself is mechanically kept clean via a blade (not shown). Fluid that is cleaned off—including toner particles—is captured for all colors via a central collection reservoir, cleaned and supplied to the central cleaning fluid storage reservoir for reuse.

The counter-pressure roller 126 is likewise cleaned via a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and provided again to the printing process (possibly cleaned) via a fluid discharge 128'.

In the print groups 11 that print the front side of the recording medium 20, the counter-pressure roller 126 presses against the unprinted side (and thus the side that is still dry) of the recording medium 20.

Nevertheless, dust/paper particles or other dirt particles can already be located on the dry side that are then removed from the counter-pressure roller 126. For this, the counter-pressure roller 126 should be wider than the recording medium 20. As a result of this, contaminants can also be cleaned off well outside of the printing region.

In the print groups 12 that print to the back side of the recording medium 20, the counter-pressure roller 126 presses directly on the damp print image 20' of the front side that has not yet been fixed. So that the print image 20' is not removed by the counter-pressure roller 126, the surface of the counter-pressure roller 126 must have anti-adhesion properties with regard to toner particles and also with regard to the cleaning fluid on the recording medium 20.

The developer station 110 inks the latent print image 20' with a predetermined toner. For this, the developer roller 111 directs toner particles towards the photoconductor. In order to ink the developer roller 111 itself with a layer over its entire area, liquid developer is initially supplied to a storage chamber from a mixing container (within the fluid control unit 71; not shown) via a fluid feed 112' with a predetermined concentration. Given a surplus, the liquid developer is supplied from this reservoir chamber 112 to a pre-chamber 113 upon overflow (a type of pan that is open at the top). An electrode segment 114 that forms a gap between itself and the developer roller 111 is arranged towards the developer roller 111.

The developer roller 111 rotates through the pre-chamber 113 (open at the top) and thereby carries liquid developer along into the gap. Excess liquid developer runs from the pre-chamber 113 back to the reservoir chamber 112.

Due to the electrical field formed by the electrical point in time between the electrode segment 114 and the developer roller 11, in the gap the liquid developer is divided into two regions, and in fact into a layer region in proximity to the developer roller 111 in which the toner particles concentrate (concentrated liquid developer) and a second region in proximity to the electrode segment 114 that is low in toner particles (very low concentration of liquid developer.

The layer of liquid developer is subsequently transported further to a dosing roller 115. The dosing roller 115 squeezes the upper layer of the liquid developer so that a defined layer thickness of liquid developer of approximately 5 μm subsequently remains on the developer roller 111. Since the toner particles are significantly located near the surface of the developer roller 111 in the cleaning fluid, the outlying cleaning fluid is significantly squeezed out or retained and ultimately is supplied to a collection container 119, but not to the storage container 112.

As a result of this, predominantly highly concentrated liquid developer is conveyed through the nip between dosing roller 115 and developer roller 111. A uniformly thick layer of liquid developer with approximately 40 percent cleaning fluid by mass thus arises after the dosing roller 115 (the mass ratios can also fluctuate more or less depending on the printing process requirements). This uniform layer of liquid developer is transported into the nip between the developer roller 111 and the photoconductor roller 101. There the image points of the latent image are then electrophoretically inked with toner particles, while no toner passes to the photoconductor in the region of the non-image points. Sufficient carrier fluid is absolutely necessary for electrophoresis. The fluid film splits approximately in the middle after the nip as a result of wetting, such that one part of the layer remains adhered to the surface of the photoconductor roller 101 and the other part (essentially carrier fluid for image points and essentially toner particles and carrier fluid for non-image points) remains on the developer roller 111.

So that the developer roller 111 can be coated again with liquid developer under the same conditions and uniformly, toner particles (these essentially represent the negative, untransferred print image) will remain, and liquid developer with be electrostatically and mechanically removed by a cleaning roller 117. The cleaning roller 117 itself is cleaned by a blade 118. The cleaned-off liquid developer is supplied to the collection container 119 for re-use, to which the liquid developer cleaned off of the dosing roller 115 (by means of a blade 116, for example) and the liquid developer cleaned off of the photoconductor roller 101 by means of the blade 104 are also supplied.

The liquid developer collected in the collection container 119 is supplied to the mixing container via the liquid discharge 119'. Fresh liquid developer and clean carrier fluid are also supplied as needed to the mixing container. Sufficient liquid in a desired concentration (predetermined ratio of toner particles to carrier fluid) must always be present in the mixing container. The concentration in the mixing container is continuously measured and regulated accordingly depending on the supply of the amount of cleaned-off liquid developer and its concentration, as well as of the amount and concentration of fresh liquid developer or, respectively, carrier fluid.

For this, the most highly concentrated liquid developer, pure carrier fluid, serum (carrier fluid and charge control substances in order to control the charge of the toner particles) and cleaned-off liquid developer can be separately supplied to this mixing container from the corresponding storage reservoirs 72.

Figure 3:
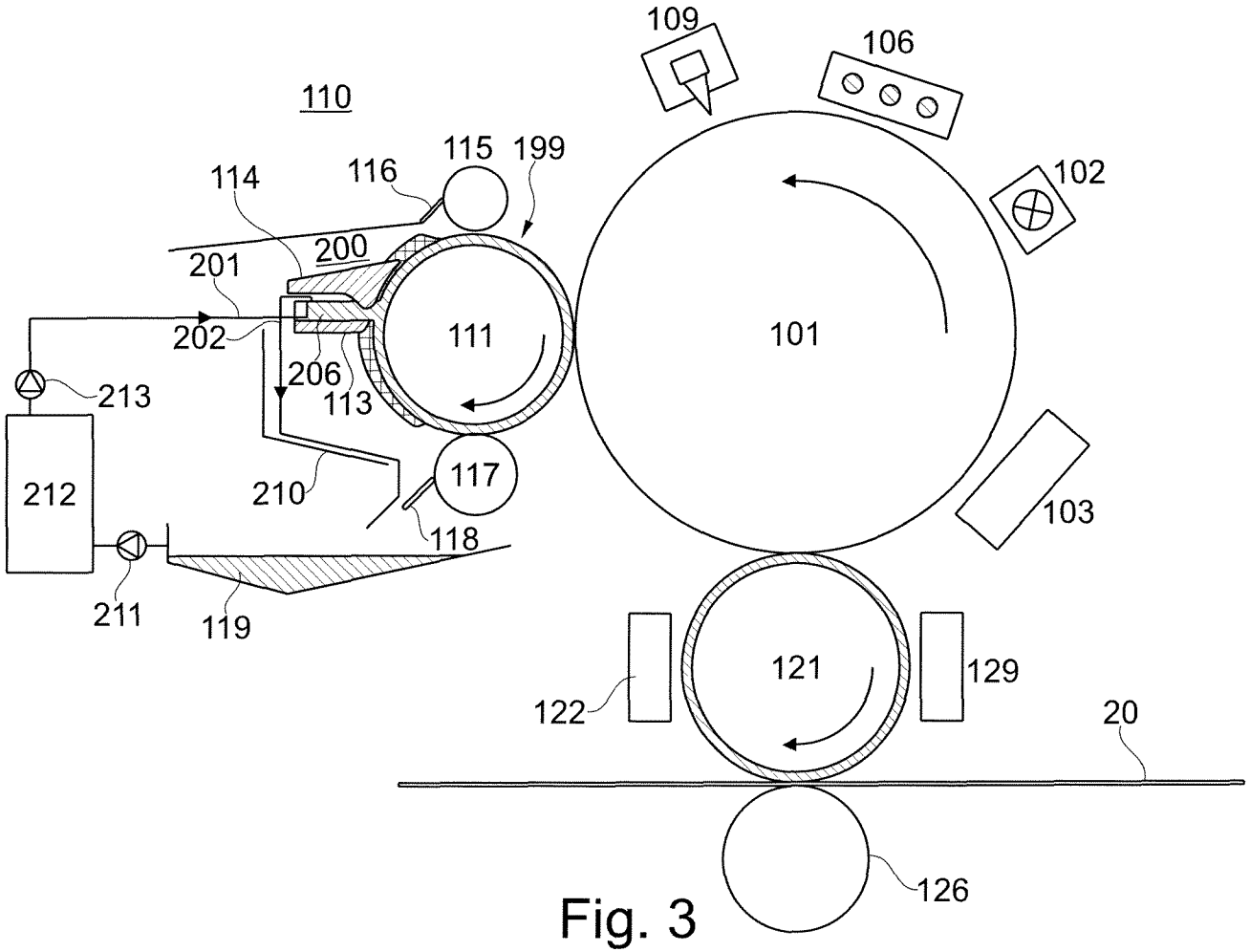
FIG. 3 illustrates a print group with a schematic diagram of a developer station.

An embodiment of a developer station 110 with which liquid developer is supplied to the photoconductor roller 101 results from FIG. 3. The embodiment assumes the developer station 110 according to FIG. 2. The same components are therefore provided with the same reference characters. The developer station 110 according to FIG. 3 comprises:

- a rotating application unit 199 that transports liquid developer directly or indirectly to the photoconductor roller 101. The application unit 199 can be the developer roller 111 that transports liquid developer to the photoconductor roller 101 (FIG. 3) or an application roller 214 that supplies liquid developer to the developer roller 111, which feeds the liquid developer to the photoconductor roller 101 (FIG. 7, 8);
- a supply system 200 that supplies liquid developer to the application unit 199;
- optionally, a cleaning unit 117, 118 with the cleaning roller 117 and with the cleaning blade 118. The cleaning roller 117 is arranged in contact with the developer roller 111 and removes residual liquid developer remaining on the developer roller 111 from said developer roller 111 after the development of the charge images; this residual liquid developer is then scraped off of the cleaning roller 117 by the cleaning blade 118;
- optionally, a dosing unit 115, 116 can be provided that can be executed as a dosing roller 115 (possibly with the blade 116) and that conditions the layer of liquid developer that is supplied to the photoconductor roller 101.

Electrical potentials are respectively applied to the function elements (such as photoconductor roller 101, developer roller 111, supply system 200, cleaning roller 17, dosing roller 115), which electric potentials change with the polarity of the toner charge (which can be positive or negative). In the following explanation the definitions apply:

- potential 1 at a first function element is higher than the potential 2 at a second function element; given a positive toner polarity this means: higher positive;
- potential 1 at a first function element is higher than the potential 2 at a second function element; given a negative toner polarity this means: higher negative. A positive toner charge is assumed in the following.

The basic function of the developer station 110 has already been explained above. The design of the supply system 200 for the application of liquid developer to the developer roller 111 or the application roller 214 in detail and the function of the supply system 200 are described in the following.

In a first exemplary embodiment, liquid developer is supplied to the developer roller 111 by the supply system 200.

In a first exemplary embodiment (FIG. 3 through FIG. 5), the supply system 200 comprises:

- in a lower region, a pre-chamber 113 that is open at the top and towards the developer roller 111, which pre-chamber 113 is filled with liquid developer—therefore has a free liquid developer surface—and serves as a compensation volume 206 in order to achieve a uniform distribution of the toner particles at the fill level of the pre-chamber 113. The liquid developer of the compensation volume 206 thus rests on the developer roller 111. The pre-chamber 113 is provided with an inlet 201 and a spillover 202 for liquid developer. The inlet 201 for liquid developer is arranged at the lower region of the pre-chamber 113; excess liquid developer is discharged from the pre-chamber 113 via the spillover 202. A sediment that has possibly deposited on the floor of the pre-chamber 113 can be discharged or at least loosened via the feed of liquid developer at the lower region of the pre-chamber 113. At the lower region of the pre-chamber 113, towards the developer roller 111, a sealing blade 203 (FIG. 4, 5) is provided that seals the pre-chamber 113 towards the developer roller 111 at the bottom. The sealing blade 203 can be an extruded plastic blade, for example can be made of Mylar®.

An electrode segment 114 is provided as an upper part, which electrode segment 114 has a clearance of 0.1 to 0.3 mm from the developer roller 111; and end part 204 of the electrode segment 114 can extend coaxially along the developer roller 111 or be situated converging towards the inlet or outlet of the developer roller 111 in the electrode segment 114. The length of the end part 204 at the circumference of the developer roller 111 can be >20 mm, advantageously can be set to 35 mm to 45 mm. Provided adjacent to the developer roller 111 on the underside of the electrode segment 114 is a molding 205 that is deeper than the spillover 202 of the pre-chamber 113 under consideration of a tolerance for vibrations of the surface of the liquid developer during operation. Air bubbles in the compensation volume 206 are prevented via the molding 205. The top side of the electrode segment 114 drops downward and is drawn behind the spillover 202. Liquid developer that is squeezed out at the contact zone with the dosing roller 114 can therefore be discharged via the top side of the electrode segment 114, for example to a storage chamber 112 (FIG. 2). Such an electric potential is present at the electrode segment 114 that the toner particles migrate to the developer roller 111 in the electric field between said electrode segment 114 and the developer roller 111.

lateral seals towards the developer roller 111, respectively via molded seals 207 (FIG. 6), for example made of foam rubber, felt.

Figure 4:
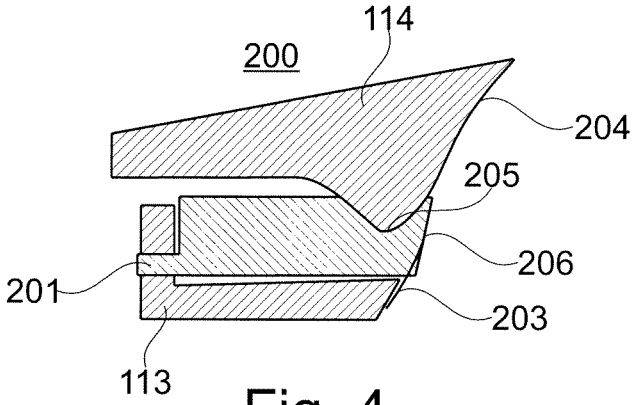
FIGS. 4 and 5 show exemplary embodiments of supply systems of liquid developer to a developer roller.
Figure 5:
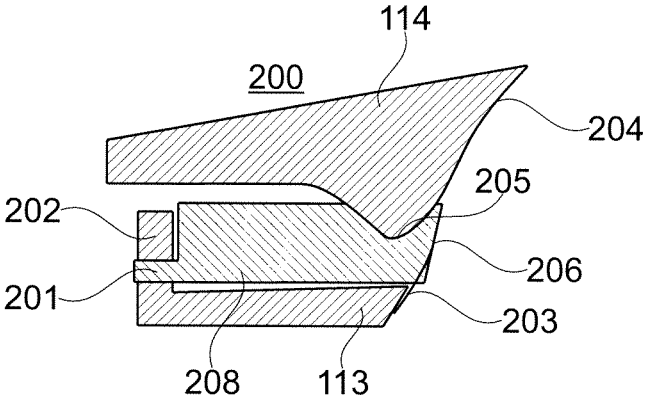

FIGS. 4 and 5 show further embodiments of the supply system 200 according to the first exemplary embodiment without developer roller 111. In FIG. 4, liquid developer is supplied via the inlet 201 to the pre-chamber 113 (and therefore to the compensation volume 206) at the lower end of said pre-chamber 113, on the far side from the developer roller 111; the spillover 202 lies at the upper end of the pre-chamber 113 and the compensation volume 206, such that excess liquid developer can always be discharged. During printing operation, more liquid developer can therefore always be supplied to the pre-chamber 113 than is discharged to the developer roller 111, with the result that the compensation volume 206 in the pre-chamber 113 is continuously exchanged.

In FIG. 5, a baffle plate 208 is inserted into the pre-chamber 113 adjacent to the inlet 201 for the liquid developer, which baffle plate 208 improves the distribution of the liquid developer in the pre-chamber 113. For this the liquid developer is directed over the baffle plate 208. Additional elements to distribute the liquid developer over the width of the pre-chamber 113 are therefore unnecessary.

In a second embodiment of a pre-chamber 113, the baffle plate 208 can be arranged so that it provides a gap at the floor of said pre-chamber 113 for the passage of the liquid developer.

Figure 6:
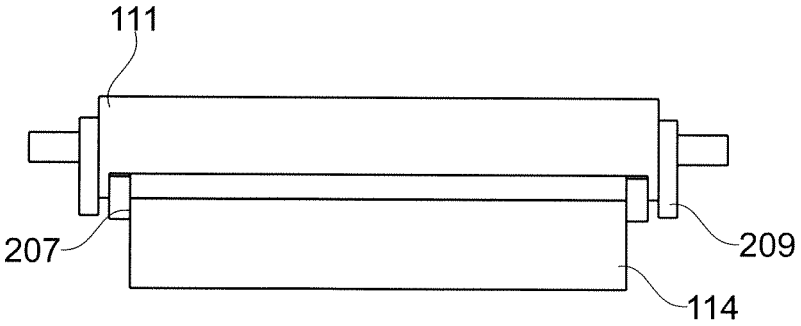
FIG. 6 shows arrangements of seals at a developer roller.

FIG. 6 shows the arrangement of seals at the developer roller 111 and the supply system 200. A seal 207 is respectively arranged at both sides of the supply system 200, which seal 207 rests on the developer roller 111 and prevents a lateral escape of liquid developer. Seals 209 are likewise provided at the sides of the developer roller 111.

The function of a developer station 110 with a supply system 200 according to FIG. 3 through 5 is explained in the following:

The liquid developer is directed via the supply system 200 to the developer roller 111, wherein the amount of toner contained in the liquid developer is greater than is necessary for the inking of the charge images on the photoconductor roller 101 (highly-concentrated liquid developer). The dosing of the toner amount transferred to the developer roller 111 takes place via the difference potential between the electrode segment 14 and the developer roller 111. The liquid developer is thereby initially supplied at a lower toner concentration (5%-20%) to the pre-chamber 113. Via the applied electric field in the gap between developer roller 111 and the electrode segment 114, the toner concentration can be modified to 15% to 50% of the liquid developer at the roller surface of the developer roller 111; a high inking of the charge images on the photoconductor roller 101 can thereby be achieved with a high electric field strength; and a low inking can be achieved with a low electric field strength.

The final dosing of the liquid developer amount before the supply to the photoconductor roller 101 can then take place between the dosing roller 115 and the developer roller 111. Contact pressure, hardness of the developer roller 111 or dosing roller 115 and roughness of the developer roller 111 or dosing roller 115 thereby determine the amount of liquid developer conveyed through the nip between the developer roller 111 and the dosing roller 115, and therefore the layer thickness of the liquid developer that arrives at the photoconductor roller 101. The dosing roller 115 thereby always has a higher potential than the developer roller 111. It is therefore ensured that no toner is unintentionally transferred to the dosing roller 115. At the same time, the toner concentration in the liquid developer layer is further increased—for example to 20% to 60% of the liquid developer—and a uniform toner distribution on the developer roller 111 is ensured.

The conditioned liquid developer subsequently arrives in the contact zone between the developer roller 111 and the photoconductor roller 101; there the charge images are inked in a known manner. The electric potentials at the developer roller 111 and the photoconductor roller 101 are selected so that toner is transferred to the photoconductor 101 at the image points and no toner is transferred to the photoconductor roller 101 at the non-image points.

The liquid developer remaining on the developer roller 11 after the development of the print image (said liquid developer is called residual liquid developer in the explanation) is subsequently removed from the developer roller 111 by the cleaning roller 117. For this an electric field exists between the developer roller 111 and the cleaning roller 117, such that the toner is drawn to the cleaning roller 117. The cleaning blade 118 that removes the residual liquid developer from the cleaning roller 117 rests on the cleaning roller 117.

The excess liquid developer from the pre-chamber 113 can be conducted via the spillover 202 and a flow conductor element 210 to the cleaning unit 117, 118. In addition to this, the liquid developer squeezed out by the dosing unit 115, 116 can likewise be supplied to the flow conductor element 210. From there the liquid developer can be used to clean the cleaning roller 117 or the cleaning blade 118. After the cleaning, the scraped-off liquid developer can be supplied to the storage chamber 112; this can be connected via a pump 211 with a mixing unit 212. The liquid developer can be supplied from the mixing unit 212 to the supply system 200 via a pump 213.

Advantages of a supply system 200 (FIG. 3-5) realized and operated in such a manner are:

Liquid developer can be supplied to the supply system 200 with approximately 10-50 times the amount of liquid developer in comparison to the liquid developer amount that can be transported through the nip between developer roller 111 and dosing roller 115. These measures have the following advantageous results:

the volume of liquid developer in the supply system 200 can be completely exchanged within 10 sec;

only 2% to 20% of the volume of liquid developer flows over the developer zone and the cleaning zone, wherein the toner particles in the liquid developer are only subject to a stress there;

the toner amount in the liquid developer mixture can be chosen to be markedly greater than the toner amount that is required for maximum inking (>20%) of the charge images, such that the toner application is saturated for every inking of the charge images on the photoconductor roller 101;

a spillover 202 is provided in the pre-chamber 113, such that the contact region with the developer roller 111 is always flooded. Liquid developer can thereby be supplied to the pre-chamber 113 in pulses or uniformly; the supplied amount can likewise be kept constant in terms of area for different printing speeds, or can be scaled with the speed;

the inking of the charge images on the photoconductor roller 101 is controlled via the electrical voltage between the electrode segment 114 and the developer roller 111. Preferred potentials at the electrode segment 114 are: 0 V to 1500 V, advantageously 200 V-800 V.

the potential at the electrode segment 114 can be adjusted corresponding to the process speed. The toner concentration at the developer roller 111, and therefore the inking of the charge images on the photoconductor roller 101, therefore remains constant.

In a second exemplary embodiment (FIG. 7) of the developer station 110, a supply system 200' can be arranged at an additionally provided application roller 214. The application roller 214 then rests on the developer roller 111; and the transfer of the liquid developer 214 to the developer roller 111 takes place in a known manner.

The supply system 200' here is arranged at the application roller 213. Here the supply system 200' has:

an electrode segment 114' at a clearance of 0.1 mm to 0.2 mm from the application roller 214; it is arranged concentric to the application roller 214; however, it is also possible to provide a gap that becomes narrower between the electrode segment 114' and the application roller 214 as viewed in the rotation direction of the application roller 214.

The electrode segment 114' and the pre-chamber 113' are combined here, wherein the electrode segment 114' has the pre-chamber 113' in the upper region.

The electrode segment 114' thus now has a compensation volume 206 in the pre-chamber 113' open towards the top, filled with liquid developer, which pre-chamber 113' is additionally open towards the application roller 214, such that the liquid developer of the compensation volume 206 rests on the application roller 214. The pre-chamber 113' provides a spillover 202' for the discharge of excess liquid developer and an inlet 201' for the supply of new liquid developer. A uniform distribution of the toner particles over the width of the application roller 214 is enabled due to the free fluid surface of the compensation volume 206 in the pre-chamber 113'.

The lateral sealing of the electrode segment 114' takes place with shaped seals, for example foam rubber seals.

A blade 215 resting on the application roller 214—which blade 215 is arranged before the inlet of the application roller 214 at the electrode segment 114'—serves for the removal of liquid developer remaining with lower toner concentration on the application roller 214 after the transfer of liquid developer to the developer roller 111, and avoids an unwanted influencing of the liquid developer in the pre-chamber 113'. For example, the removed liquid developer flows to the spillover 202'. The developer mixture with low toner concentration that is collected there can be directed to the cleaning unit 117, 118.

Figure 7:
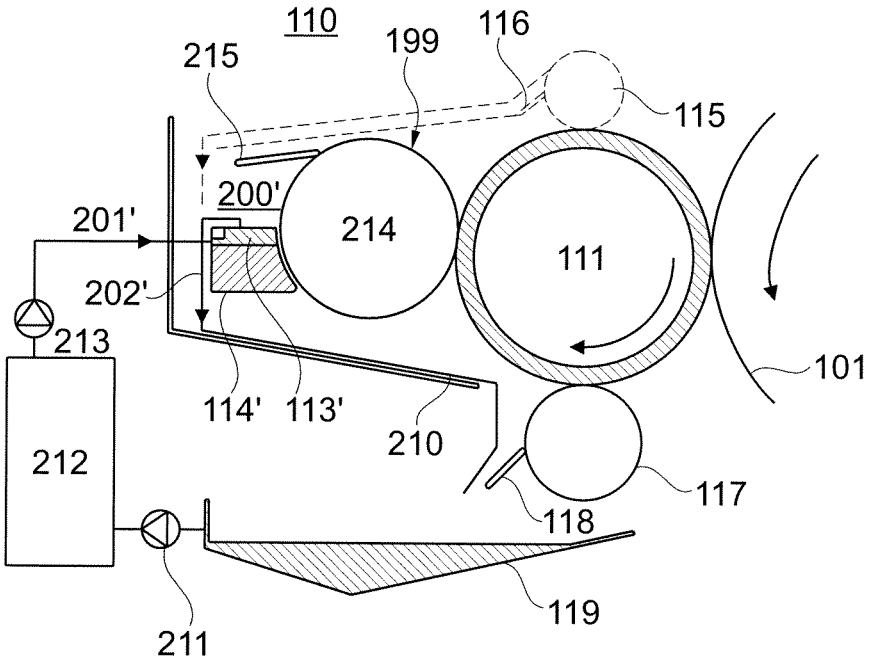
FIG. 7 illustrates a representation of a supply system for an application roller from which the liquid developer is transferred to a developer roller.
Figure 8:
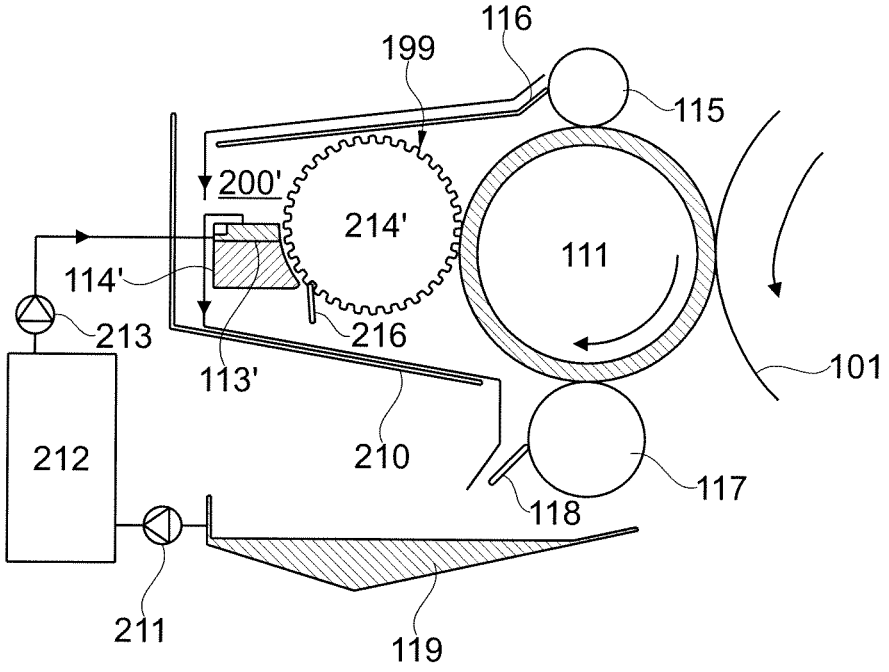
FIG. 8 is a representation of a supply system for a screen roller as an application roller.

In FIG. 7, the application roller 214 has a smooth surface. The application roller 214 can optionally be executed as a screen roller 214' (FIG. 8). A blade 216 that removes excess liquid developer from the screen roller 214' can then be arranged at the outlet of the electrode segment 114'.

The liquid developer is transferred in a known manner from the application roller 240 to the developer roller 111. The function of the supply system 200' for the application roller 214, 214' corresponds to the function of the supply system 200 according to FIG. 3 through FIG. 5; refer to these.

In summary, the following advantages result for a developer station 110 with a supply system 200 or 200':

1) The toner particles are deposited in a defined manner within the liquid developer on each function element (application roller 214, developer roller 111). Fluctuations in the toner properties (charge, diameter) are therefore compensated.

2) The excess delivery in the toner application to the developer roller 111 enables speed variations to be compensated (the toner delivery can be constant);

delivery fluctuations to be compensated (toner delivery can be pulsed);

a reaction-free supply system 200, 200' results in combination with the electrode segment 114, 114' and the spillover 202, 202' in the pre-chamber 113, 113' since the liquid developer is completely exchanged;

a stable response of the liquid developer mixture is present because the liquid developer is affected only in small part by stress in the developer zone and cleaning zone since only 2%-10% of the supplied liquid developer is conveyed in these zones.

3) The application of liquid developer via the pre-chamber 113, 113' with compensation volume 206 directly to the developer roller 111 or application roller 214 is advantageous since the toner in the compensation volume 206 distributes transverse to the printing direction, and therefore additional measures for cross-distribution are foregone;

the supply can be asymmetrical;

the supply at the lower end of the compensation volume 206 has the effect of the avoidance of sedimentation in the pre-chamber 113, 113'.

4. The strong concentration of the liquid developer via the electrode segment 114, 114' is advantageous since a good flow capability of the liquid developer in particular to the developer roller 111 is achieved;

a long concentration time at the developer roller 111 is possible via a corresponding length of the end part 204 of the electrode segment 114 (and developer roller diameter) so that a very high print speed (5>m/s) is therefore indirectly achieved;

the length of the end part 24 of the electrode segment 114 moreover leads to a homogenization of the flow to the developer roller 111, and therefore to the deposition of liquid developer.

5) The optimal toner concentration is adjusted for each process step:

A low toner concentration in the liquid developer is assumed for good flow capability of the liquid developer for the transport of the liquid developer into the developer station before reaching the developer roller 111.

An increase of the toner concentration in the application to the developer roller 111 subsequently takes place for a dynamically adjustable inking level of the charge images on the photoconductor roller 101.

Additional concentration of the liquid developer takes place via a conditioning via the dosing roller 115; this avoids the discharge of excess cleaning fluid at the non-image points on the photoconductor roller 101.

The additional concentration of the liquid developer via the conditioning via the dosing roller 115 enables the adjustment of an optimal cohesion of the liquid developer layer for the image development, and additional transfer to a recording medium.

The direct return of liquid developer low in toner to the cleaning unit 117, 118 is enabled a) from the spillover 202 of the supply system 200;

b) from the blade 116 of the dosing roller 115, since the reduction of the toner concentration before the cleaning leads to good mobility of the toner particles, and therefore to reduced toner stress upon cleaning.

The photoconductor can preferably be designed in the form of a roller or as a continuous belt. An amorphous silicon can thereby be used as a photoconductor material, or an organic photoconductor material (also designated as an OPC) can be used.

Instead of a photoconductor, other image carriers (such as magnetic, ionizable etc. image carriers) can also be used that do not operate according to the photoelectric principle, but rather which are impressed with latent images electrically, magnetically or in another manner according to other principles, which latent images are then inked and ultimately are transferred to the recording medium 20.

LED lines or even lasers with corresponding scan mechanism can be used as a character generator 109.

The transfer element can likewise be designed as a roller or as a continuous belt. The transfer element can also be omitted. The print image 20' is then directly transferred from the photoconductor roller 101 to the recording medium 20.

What is to be understood by the term "electrophoresis" is the migration of the charged toner particles in the carrier fluid as a result of the action of an electrical field. At each transfer of toner particles, the corresponding toner particles essentially completely pass to a different element. After contacting the two elements, the fluid film is approximately split in half as a result of the wetting of the participating elements, such that approximately one half remains adhered to the first element and the remaining part remains adhered to the other element. The print image 20' is transferred and then transported further in the next part in order to allow an electrophoretic migration of the toner particles again in the next transfer region.

The digital printer 10 can have one or more print groups for the front side printing and (if applicable) one or more print groups for the back side printing. The print groups can be arranged in a line, L-shaped or U-shaped.

Instead of the take-up stand 27, post-processing devices (not shown) can also be arranged after the feed group 26, such as cutters, folders, stackers etc. in order to bring the recording medium 20 into the final form. For example, the recording medium 20 could be processed so far that a finished book is created at the end. The post-processing apparatuses can likewise be arranged in series or curved away from this.

As was previously described as a preferred exemplary embodiment, the digital printer 10 can be operated as a roll-to-roll printer. It is also possible to cut the recording medium 20 into sheets at the end and to subsequently stack the sheets, or to further process them in a suitable manner (roll-to-sheet printer). It is likewise possible to feed a sheet-shaped recording medium 20 to the digital printer 10, and to stack the sheets or process them further at the end (sheet-to-sheet printer).

If only the front side of the recording medium 20 is printed, at least one print group 11 with one color is thus required (simplex printing). If the back side is also printed, at least one print group 12 is also required for the back side (duplex printing). Depending on the desired print image 20' on the front side and back side, the printer configuration includes a corresponding number of print groups for front side and back side, wherein every print group 11, 12 is always designed for only one color or one type of toner.

The maximum number of print groups 11, 12 is only technically dependent on the maximum mechanism draw load of the recording medium 20 and the free feed length. Arbitrary configurations are typically possible, from a 1/0 configuration (only one print group for the front side to be printed) to a 6/6 configuration in which six print groups can respectively be present for the front side and back side of the recording medium 20. The preferred embodiment (configuration) is shown in FIG. 1 (a 4/4 configuration), with which full-color printing with the four primary colors is produced for the front side and back side. The order of the print groups 11, 12 in four-color printing advantageously proceeds from a print group 11, 12 that prints in light color (yellow) to a print group 11, 12 that prints in dark color, thus for example that prints the recording medium 20 in the color order Y-C-M-K from light to dark.

The recording medium 20 can be produced from paper, metal, plastic or other suitable and printable materials.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A digital printer to print to a recording medium, comprising:

at least one print group with at least one station to generate charge images of images to be printed on a charge image carrier;

at least one developer station to ink the charge images on the charge image carrier using liquid developer having toner and carrier fluid; and the developer station having an application unit via which the liquid developer is transported to the charge image carrier, and a supply system arranged adjacent and laterally situated to the application unit for supply of the liquid developer to said application unit, the supply system having a pre-chamber and an electrode segment, the pre-chamber being filled with liquid developer and open towards the laterally situated application unit and additionally open at a top such that a compensation volume of liquid developer with an open surface is created past which the application unit passes to transfer liquid developer, the electrode segment being arranged adjacent to the pre-chamber and to a side of the application unit such that it forms a gap with said application unit through which the liquid developer is directed, and the electrode segment being at such an electrical potential that the toner of the liquid developer transfers to the application unit in the gap.

2. The digital printer according to claim 1 wherein the pre-chamber of the supply system has a laterally arranged inlet for liquid developer and a spillover for liquid developer, wherein more liquid developer is supplied to the pre-chamber than transfers to the application unit, and excess liquid developer accepted by the application unit is discharged via the spillover.

3. The digital printer according to claim 2 wherein a baffle plate is arranged in the pre-chamber via which or below which baffle plate the liquid developer supplied via the inlet is directed.

4. The digital printer according to claim 2 wherein a cleaning unit is provided on the application unit, said excess liquid developer being supplied to said cleaning unit from the spillover of the pre-chamber via a flow direction element.

5. The digital printer according to claim 2 wherein a dosing unit to condition the liquid developer on the application unit is arranged at said application unit, liquid developer removed from said application unit being supplied to the spillover.

6. The digital printer according to claim 1 wherein the electrode segment opens in an end part extending adjacent to the application unit, said end part being situated in parallel to the application unit.

7. The digital printer according to claim 1 wherein the electrode segment opens in an end part extending adjacent to the application unit, said end part being situated at a varying distance from said application unit.

8. The digital printer according to claim 1 wherein the electrode segment opens in an end part extending adjacent to the application unit, said end part being situated converging coaxially with said application unit.

9. The digital printer according to claim 1 wherein a sealing blade is arranged resting on the application unit at a lower end of the pre-chamber.

10. The digital printer according to claim 1 wherein the supply system has the electrode segment at a top and the pre-chamber at a bottom, wherein the electrode segment has a molding in a direction of the pre-chamber adjacent to the application unit such that the molding extends into the compensation volume.

11. The digital printer according to claim 10 wherein a tip of the molding of the electrode segment is situated lower than a spillover of the pre-chamber.

12. The digital printer according to claim 10 wherein the electrode segment is drawn over a spillover of the pre-chamber.

13. The digital printer according to claim 1 wherein the supply system pre-chamber is inserted into the electrode segment.

14. The digital printer according to claim 1 wherein the application unit comprises a developer roller that moves the liquid developer past the charge image carrier.

15. The digital printer according to claim 1 wherein a developer roller and an application roller arranged adjacent to the developer roller are provided as an application unit, the supply system being arranged adjacent to the application roller wherein the application roller transports the liquid developer from the supply system to the developer roller, and the developer roller transports the liquid developer to the charge image carrier.

16. The digital printer according to claim 15 wherein a blade is arranged on the application roller before the electrode segment as viewed in a rotation direction of the application roller, said blade scraping remaining liquid developer that has not transferred to the developer roller from the application roller.

17. A digital printer to print to a recording medium, comprising:

at least one station to generate charge images of images to be printed on a charge image carrier;

at least one developer station to ink the charge images on the charge image carrier using liquid developer having toner and carrier fluid; and the developer station having an application unit via which the liquid developer is transported to the charge image carrier, and a supply system laterally situated to the application unit for supply of the liquid developer to said application unit, the supply system having a pre-chamber and an electrode segment, the pre-chamber being filled with liquid developer and open towards the laterally situated application unit and additionally at least partially open at a top such that a compensation volume of liquid developer with an open surface is created past which the application unit passes to transfer liquid developer, the electrode segment being arranged adjacent to the pre-chamber and to a side of the application unit such that it forms a gap with said application unit through which the liquid developer is directed, and the electrode segment being at such an electrical potential that the toner of the liquid developer transfers to the application unit at the gap.

* * * * *